US005128582A

United States Patent [19]

Luyckx et al.

[11] Patent Number: 5,128,582

[45] Date of Patent: Jul. 7, 1992

[54] HIGH PRESSURE DISCHARGE LAMP WITH AN EXTERNAL IGNITION ANTENNA

[75] Inventors: Felix C. J. L. Luyckx; Cornelius A. J. Jacobs; Franciscus N. G. R. Van Der Kruijs, all of Turnhout, Belgium

[73] Assignee: U.S. Philips Corporation, New York, N.Y.

[21] Appl. No.: 733,924

[22] Filed: Jul. 22, 1991

[30] Foreign Application Priority Data

Aug. 23, 1990 [NL] Netherlands ..... 9001855

[51] Int. Cl.[5] ..... H01J 1/88; H01J 7/36; H01J 61/54

[52] U.S. Cl. ..... 313/25; 313/594; 313/607; 315/73

[58] Field of Search ..... 313/25, 594, 607; 315/73

[56] References Cited

U.S. PATENT DOCUMENTS 4,445,073 4/1984 Wyner et al. ..... 313/594
4,498,030 2/1985 Govaerts et al. ..... 315/73

*Primary Examiner*—Donald J. Yusko
*Assistant Examiner*—Nimeshkumar D. Patel
*Attorney, Agent, or Firm*—Brian J. Wieghaus

[57] ABSTRACT

The invention relates to a high-pressure sodium discharge lamp in which the elongate discharge vessel is provided with an external ignition antenna consisting of a thin spiralized wire. According to the invention, an end of the antenna is fixed directly to a support member without a mandril at a location axially spaced from said discharge vessel in the extended direction of the discharge vessel and mounted elastically and with pretension over substantially its entire length.

4 Claims, 1 Drawing Sheet

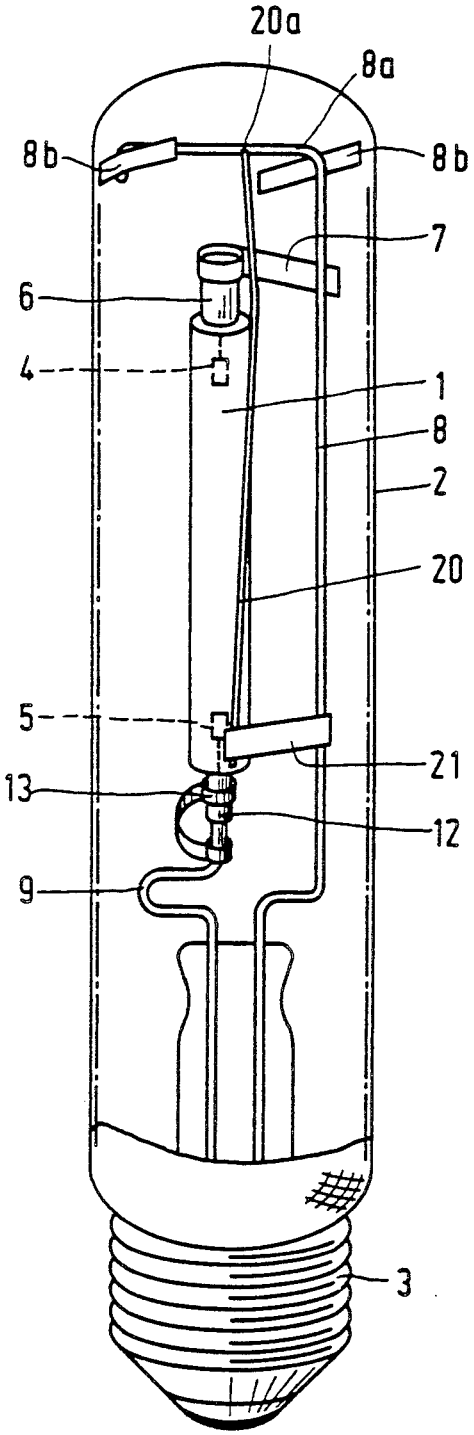
20a
8a
8b
8b
7
6
4
1
8
2
20
5
21
13
12
9
3

HIGH PRESSURE DISCHARGE LAMP WITH AN EXTERNAL IGNITION ANTENNA

BACKGROUND OF THE INVENTION

The invention relates to a high-pressure discharge lamp having an elongate discharge vessel provided with an external ignition antenna which is formed from a thin spiralised wire which extends mainly alongside the discharge vessel and which lies against the discharge vessel in the cold state of the lamp and is fixed with one end to a support member.

A lamp of the kind described in the opening paragraph is widely used in, for example, public lighting. The known lamp, in which the discharge vessel is filled with sodium, mercury and rare gas is an efficient light source. The discharge vessel is provided with sealing constructions on either side. Each sealing construction comprises an electrically conducting lead-through element which is internally provided with a main electrode and which is externally electrically connected to a current supply conductor of the lamp. In the known lamp, the external ignition antenna is fixed to a support strip which supports a lead-through element of the discharge vessel on a current supply conductor and which at the same time provides the electric connection between the rigid supply conductor and the lead-through element of the discharge vessel.

The portion of the external antenna between the fixing point on the support strip and the portion lying alongside the discharge vessel is, in the known lamp, provided with a fixed mandril and is so bent away from the longitudinal axis of the discharge vessel that the fixing point is situated immediately next to the discharge vessel. The fixed mandril serves to give the bent-away portion sufficient rigidity so that the portion lying alongside the discharge vessel remains correctly positioned.

In the known lamp, practical problems occur with the construction of the external ignition antenna. Owing to the great heat load, the thin spiral is found to show plastic deformation, so that sagging of the ignition antenna starts to occur as early as after a working life of a few hundred hours. Sagging results in that the external ignition antenna no longer lies securely against the discharge vessel in the cold state of the lamp, which is disadvantageous for a good lamp ignition.

A further disadvantage of the known construction is that both the position of the fixing point on the support strip of the end and the positioning of the ignition antenna alongside the discharge vessel have to be fairly accurate, inter alia as a result of the rigid mandril.

SUMMARY OF THE INVENTION

The invention has for its object to provide a measure by which the disadvantages described above can be eliminated to a considerable degree. To that end, a lamp of the kind described in the opening paragraph is characterized in that the fixed end is fixed directly to said support member without a mandrel at a location axially spaced from said discharge vessel in the extended direction of the discharge vessel and at a the external ignition antenna being mounted elastically and pretensioned over substantially its entire length.

Fixation of the antenna end in the extension of the discharge vessel at a distance from the discharge vessel realises in a simple and effective manner that the portion of the external ignition antenna between the fixing point and the nearby sealing construction is hardly loaded thermally so that it undergoes no deformation during life. The combination of this with an elastic and pretensioned mounting accommodates and compensates the plastic deformation which occurs during life in that portion of the external ignition antenna which is thermally loaded.

High-pressure discharge lamps in general have outer bulbs provided with lamp caps and enclosing the discharge vessels with intervening space. This space may be filled with an inert gas such as, for example nitrogen. The space is evacuated in many types of high-pressure sodium lamps.

In practical lamps, a rigid current supply conductor in the lamp often constitutes a support member by which the discharge vessel is supported. For that purpose, the rigid current supply conductor comprises a portion which is situated substantially in a plane through and making an angle with the longitudinal axis of the discharge vessel and which is present in the part of the space situated between an end construction of the discharge vessel and the nearby portion of the outer bulb. In lamps with a comparatively high power rating, supporting of the discharge vessel often takes place by means of a support member which has one or several support points on the outer bulb. Preferably this support member is integral with a rigid current supply conductor, but this is not necessary.

It is advantageous, therefore in a lamp according to the invention, to fasten the fixed end to a rigid current supply conductor. In an other advantageous embodiment, the fixed end is fastened to a support member which rests against the outer bulb.

A comparable construction is possible with a separate support member, which is present in a similar position in the outer bulb, instead of the rigid current supply conductors.

BRIEF DESCRIPTION OF THE DRAWING

An embodiment of a lamp according to the invention will be explained in greater detail below with reference to a drawing.

FIG. 1 is a side elevation of a high pressure sodium discharge lamp.

DESCRIPTION OF THE PREFERRED EMBODIMENTS

In the drawing, 1 denotes an elongate discharge vessel which is surrounded with intervening space by an outer bulb 2. The outer bulb 2 is provided with a lamp cap 3. The elongate discharge vessel 1 is provided at either end with a sealing construction which comprises an electrically conducting lead-through element 6, 12, internally fitted with a main electrode 4, 5. Lead-through element 12 is mechanically supported by a rigid current supply conductor 9 and connected with electrical conduction to the rigid current supply conductor 9 via a flexible conductor 13.

The lead-through element 6 is mechanically and electrically connected to a rigid current supply conductor 8 by means of a support member 7. The rigid current supply conductor 8 comprises a portion 8*a* which is situated substantially in a plane through and encloses and angle with the longitudinal axis of the discharge vessel 1, and which is present in the part of the space between the lead-through element of the discharge vessel 1 and the nearby portion of the outer bulb 2 which is in the extended direction of the discharge vessel. Portion 8*a* of the rigid current supply conductor 8 is provided with brackets 8*b* which rest against the outer bulb 2. The brackets 8*b* thus constitute support members which are integral with the rigid current supply conductor 8 and which each have a different support point on the outer bulb. An end 20*a* of an external ignition antenna 20 is fastened to portion 8*a*. The end 20*a* is thus fixed. At its other end, the ignition antenna 20 is fastened to a bimetal 21 which in its turn is fastened to the rigid current conductor 8. The antenna 20 is a thin spiralised wire which extends substantially alongside the discharge vessel 1. In the cold state of the lamp, the bimetal 21 rests against the discharge vessel 1, so that the external ignition antenna lies against the discharge vessel.

Practical lamps were made of the kind indicated in the FIG. They were high-pressure sodium lamps with a power rating of 400 W, type Comfort. The lamp voltage was on average 1.6 V. A tungsten wire of 0.1 mm diameter spiralised with a diameter of 0.6 mm was used as the external ignition antenna. The external antenna has a length of 76 mm without pretensioning. The wire was pretensioned during mounting and brought to a length of 113 mm. 80 mm of this length extends alongside the discharge vessel.

The practical lamps were subjected to a 1000 hour life test. After 1000 burning hours, the external ignition antennas did not show any sagging whatsoever. The antennas were also found still to be under such a prestress that no vibration of the external antennas occurred upon possible tapping against the lamps. The external antenna was then dismounted in order to ascertain the elongation resulting from plastic deformation. This amounted to 18 mm.

For the sake of comparison, it should be noted that the first sagging effects already occur after 100 burning hours for commercially available lamps of the Philips SONT type 400 W, Comfort, while after 1000 burning hours in a horizontal burning position of the lamp a greatest sagging of the external ignition antenna of 3 mm occurs. The external ignition antenna was manufactured from tungsten wire with a diameter of 0.1 mm. At one end, the tungsten wire was stiffly coiled on a MO-mandril of 0.4 mm diameter and a length of 25 mm. The portion of the external ignition antenna which extended alongside the discharge vessel was 70 mm long.

We claim:

1. A high-pressure discharge lamp having an elongate discharge vessel, a support member, and an external ignition antenna comprised of a spiralized wire which extends mainly alongside said discharge vessel, said antenna lying against said discharge vessel in the cold state of the lamp and having a fixed end fixed to said support member, characterized in that:

said fixed end is fixed directly to said support member without a mandril at a location axially spaced from said discharge vessel in the extended direction of said discharge vessel, said external ignition antenna being mounted elastically and pretensioned over substantially its entire length.

2. A high-pressure discharge lamp as claimed in claim 1, characterized in that said support member is comprised by a rigid current conductor and the fixed end of the external ignition antenna is fastened to said rigid current conductor.

3. A high-pressure discharge lamp as claimed in claim 2, characterized in that an outer bulb encloses said discharge vessel with intervening space, and in that said support member to which said fixed end of said external ignition antenna is fixed rests against the outer bulb.

4. A high-pressure discharge lamp as claimed in claim 1, characterized in that an outer bulb encloses said discharge vessel with intervening space, and in that said support member to which said fixed end of said external ignition antenna is fixed rests against the outer bulb.

* * * * *